US007032519B2

(12) United States Patent
Luxem et al.

(10) Patent No.: US 7,032,519 B2
(45) Date of Patent: Apr. 25, 2006

(54) SENSOR MECHANISM FOR A PRINTING MACHINE

(75) Inventors: Wolfgang Eberhard Luxem, Kiel (DE); Ralph Petersen, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 81 days.

(21) Appl. No.: 10/887,674

(22) Filed: Jul. 9, 2004

(65) Prior Publication Data

US 2005/0011385 A1 Jan. 20, 2005

(30) Foreign Application Priority Data

Jul. 19, 2003 (DE) ..... 103 32 879

(51) Int. Cl.
*B41F 1/34* (2006.01)

(52) U.S. Cl. ..... 101/485; 101/484; 101/486; 400/708

(58) Field of Classification Search ..... 101/484–486; 400/706, 708, 709
See application file for complete search history.

(56) References Cited

U.S. PATENT DOCUMENTS 5,769,549 A * 6/1998 Kouzai et al. ..... 400/240.4
6,655,287 B1 * 12/2003 Jojima et al. ..... 101/485
2004/0226470 A1 * 11/2004 Boness et al. ..... 101/485

* cited by examiner

*Primary Examiner*—Minh Chau
(74) *Attorney, Agent, or Firm*—Lawrence P. Kessler

(57) ABSTRACT

Controlling a sensor mechanism for a printing machine, in which the sensor mechanism in a printing machine detects, in an initial operational mode, at least one mark and the detection of the mark initiates a second operational mode in which the optical density and the color of the mark are detected by the sensor mechanism.

9 Claims, 1 Drawing Sheet

SENSOR MECHANISM FOR A PRINTING MACHINE

FIELD OF THE INVENTION

The invention pertains to a sensor mechanism for a printing machine wherein the sensor has a first operational mode for detecting a mark and a second operational mode for detecting the optical density and color of such mark.

BACKGROUND OF THE INVENTION

Sensor technology is widespread in many areas of technology, for example, in industrial automation and increasingly in automobile manufacturing. In the area of printing machines, sensors are used, for example, to automatically detect a sheet of printing medium or a compass or register mark. With the aid of a compass or register mark detected, in this way, the position of a sheet of paper on a printing machine conveyor belt or the position of the printed image in relation to the sheet of paper can be determined. In the printing industry, customers are increasingly demanding quality from printed products created by printing machines. One goal in the development of printing machines is to meet this demand for quality.

SUMMARY OF THE INVENTION

The object of the invention is to provide higher quality print from a printing machine. The invention achieves this object by controlling a sensor mechanism for a printing machine in which the sensor mechanism detects at least one mark during an initial mode of operation, and detection of that mark initiates a second mode of operation, in which the optical density and the color of the mark are detected by the sensor mechanism. Beneficially the optical density of the mark is determined and then, using the results obtained with respect to the optical density, the color of the mark is determined. Thus, several characteristics are detected with a single measurement.

In one embodiment, the detection of the edge of the mark initiates illumination of the mark with a least three different colors. This version allows particularly suitable color measurements of the mark. In addition, when illuminated with several colors, the mark provides a suitable contrast, which is easily detected by the sensor mechanism.

In a beneficial embodiment of the invention, the values of the optical density and the color of the mark contained on different printing media as carriers of the mark are multiplied by correction value that is specific to the printing medium. In this way, the fact that the printing medium influences the optical density and color of the mark and that thus the optical density and color of the mark have different values with different printing media is taken into account.

In another beneficial embodiment of the invention, the values of the optical density and the color of the mark in the case of different shadings of the conveyor belt as the carrier of the mark are multiplied by a correction value that is specific to the conveyor belt. In doing so, changes in the detected values that may be attributable to soiling or the age-dependent discolorations of the conveyor belt are taken into consideration.

In a special embodiment, the sensor mechanism incorporates a differential diode that makes possible a sensitive measurement of the optical density and the color of the mark.

The invention, and its objects and advantages, will become more apparent in the detail description of the preferred embodiment present below.

BRIEF DESCRIPTION OF THE DRAWINGS

In the detailed description of the preferred embodiments of the invention present below, reference is made to the accompanying drawings, in which.

BRIEF DESCRIPTION OF THE DRAWINGS

Figure 1:
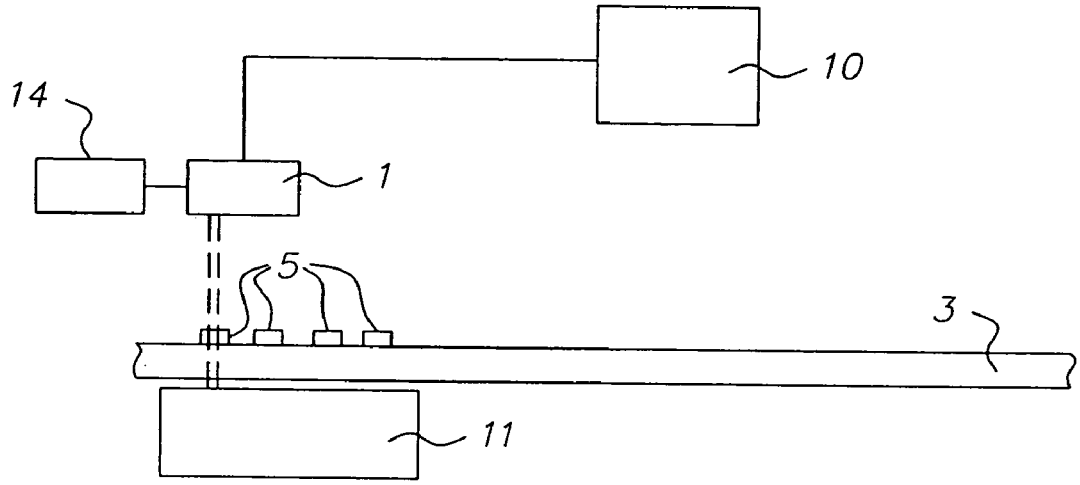
FIG. 1 shows a schematic view of a sensor mechanism in a printing machine with a section of a transparent conveyor belt and a reflector.

Referring now to the accompanying drawings, FIG. 1 shows a schematic view of a sensor mechanism 1 in a printing machine. The sensor mechanism 1 is mounted above a transparent, endless conveyor belt 3, of which a section is shown here. The sensor mechanism 1 incorporates a light emitter for emitting light and a receiver for receiving the reflected light. The sensor mechanism 1 can incorporate one or more individual sensors. Marks 5 are imprinted on the conveyor belt 3; they are depicted schematically here by squares. In addition, the marks can be imprinted on a printing medium, whereby the sensor mechanism 1 detects the leading edge of a printing medium, possibly a sheet of paper, and subsequently the marks 5.

The marks 5 are compass and register marks. Register marks are marks that serve to determine the position of a printed image on a sheet of paper, while compass marks are marks that are used the same way with respect to multi-color printing. In particular, the register designates the position of color applications relative to the outside edges of a sheet of paper and the compasses indicate the position of the color applications relative to one another.

The individual color applications, printed one upon the other, combine together to form a multi-colored image. The marks 5 are imprinted either on the conveyor belt 3 or on a printing medium, possibly a sheet of paper. The marks 5 are each applied by the printing machine's individual printing mechanisms or printing modules, and always depict one color of the printing machine, in this example four colors, black, yellow, magenta, and cyan. The arrangement of marks 5 here are only exemplary; other arrangements may be contemplated.

The sensor mechanism 1 is initially set in a primary operational mode, and it sends a light signal in the direction of the conveyor belt 3, which in the current case, in which the marks 5 are imprinted on the conveyor belt 3, impinges on either a mark 5 or the conveyor belt 3. Most of the light is reflected from the mark 5 and received by the sensor mechanism 1. Most of the light that impinges on the conveyor belt 3 passes through the transparent conveyor belt and impinges on a reflector 11 that is located beneath the conveyor belt 3. The reflector 11 reflects most of the light that is striking it back to the sensor mechanism 1. The individual marks 5 are detected by the difference in the contrast received by the sensor mechanism 1, when a mark 5 is present, on the one hand, and when no mark 5 is present, on the other hand. When a mark 5 is present in the light path between the sensor mechanism 1 and the reflector 11, less light is received by the receiver, in the sensor mechanism 1 than when no mark 5 is present in the light path.

In particular, a signal that is generated by the detection of the edge of the mark 5 is always sent to a control mechanism 10. If the light signal from the sensor mechanism 1 strikes a mark 5 and is reflected, the sensor mechanism 1 receives a different, stronger signal than when the light signal strikes the conveyor belt. In this way, the edge of mark 5 is detected. From the position of the edge of the mark 5, a determination is made as to whether the register and/or the compass is/are properly positioned, i.e., whether the position of mark 5 on the conveyor belt 3 is different from the target position. For this purpose, a timing count is begun in the control mechanism, which stops when the edge of mark 5 is detected. An impulse triggers the timing count, which, for example, simulates the leading edge of a sheet of paper on the conveyor belt. Consequently, a timing count obtained in this way corresponds to a simulated timing count from a leading edge of the sheet of paper to the edge of the mark 5, whereby the timing count corresponds to a distance. The target position of the mark 5 is stored in the control mechanism as a target timing count. A comparison of the target timing count with the measured timing count shows any deviation of the mark 5 in terms of the direction of travel, the so-called in track error.

When the edge of the mark 5 is detected, the sensor mechanism 1 is switched to a second operational mode, and the process of determining the optical density and the color of the mark 5 is initiated. The sensor mechanism 1 is consequently self-triggering, i.e., detection of the optical density and the color of the mark 5 in the second operational mode is initiated on the basis of elapsed time by the detection of the edge of the mark 5. Initiation of the second operational mode is usually accomplished by a pulse. For this purpose, a triggering mechanism 14 is provided, which is connected to the sensor mechanism 1. The triggering mechanism 14 is shown in the drawings as a separate circuit box, but it can also be incorporated in either the sensor mechanism 1 or the control mechanism 10.

The triggering mechanism 14 incorporates an electronic switch, which triggers the detection of the optical density and the color of the mark 5 by the sensor mechanism 1 when it receives the detection signal upon detection of the edge of the mark 5. Based upon the signal when the edge of the mark 5 is detected by the sensor mechanism 1, measurement of the optical density, and the color of the mark 5 takes place. In the control mechanism 10, an optical density is assigned to the reflected light received from the mark 5. The optical density of the mark 5 is determined by measuring the amplitude of the signal that is formed from the difference between the received light signal from light falling on the conveyor belt 3 and the received light signal from light falling on the mark 5. The signal level of the resulting signals is a gauge of the difference between the conveyor belt 3 and the mark 5.

In addition, the color of the mark 5 is determined with the same measurement by the sensor mechanism 1, one after the other, the color black, yellow, magenta, and cyan in this example consonant with one after the other colors of the marks 5 on the conveyor belt 3. For this purpose, the sensor mechanism 1 incorporates either a color filter or a spectral identification apparatus. If color filters are used in the light emitter, the light that is sent out from the sensor mechanism 1 in the direction of the marks 5 after the leading edge of the mark 5 has been detected will consist of at least three colors. In this process, the individual colors are transmitted in quick succession, one after the other. From the signals of the individually transmitted colors that are received, in the case of three different colors there will be three signals, the color of the mark 5 is subsequently determined in the control mechanism 10. Thus, the color of each mark 5 is measured with at least three different color beams.

This color determination is particularly beneficial in the range of the lighter and medium shades. In the version that uses a spectral identification apparatus, a reflected and received bundle of light beams is separated in the control mechanism into its frequency components, which identify the individual colors, each of which is capable of being analyzed. All of the information necessary for measuring the density, color, and register is contained in the light signal reflected from the mark 5; it is detected by the sensor mechanism 1 and analyzed by the control mechanism 10. If for a certain period of time no edge of a mark 5 is detected, the triggering mechanism 14 switches the sensor mechanism 1 back to the first operational mode. When the edge of a subsequent mark 5 is detected the second operational mode is again initiated as described above.

In the case where the marks 5 are imprinted on a printing medium, the sensor mechanism first detects the leading edge of the printing medium and transmits a signal to the control mechanism 10. Triggered by the sensor signal, a number of clock pulses are counted until the first mark 5 on the printing medium is detected. The number of clock pulses occurring from the leading edge of the printing medium until the first mark 5 corresponds to a length so that the actual distance from the leading edge of the printing medium up to the first mark 5 is known. In one embodiment, the clock pulses come from an encoder on a guide roller that controls the movement of the conveyor belt 3 so that a length on the travel path 3 corresponds to a number of clock pulses from the encoder. Because the conveyor belt carries the printing medium, to know this length is to know the distance from the leading edge to the mark 5. The distances from the leading edge of the printing medium to the remaining marks 5 are measurable in the same way.

Figure 2:
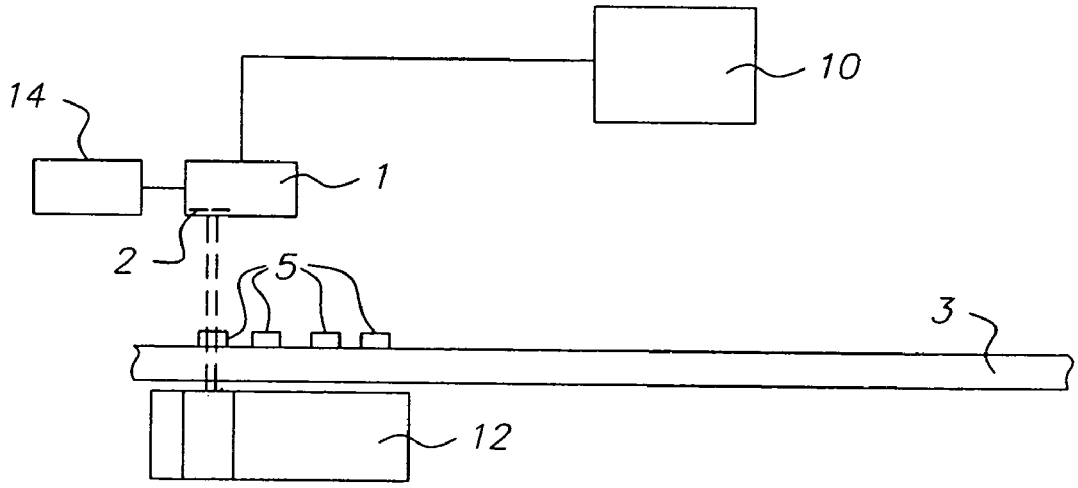
FIG. 2 shows a schematic view of an alternate sensor mechanism in a printing machine with a section of a transparent conveyor belt and a reflector.

FIG. 2 shows a version of the invention by a schematic view of a section of the conveyor belt 3, on which, an array of marks 5 have been imprinted. In contrast with the embodiment shown in FIG. 1, here a light signal is sent out from a lighting mechanism 12 that is located under the transparent conveyor belt 3. Most of the beam from the lighting mechanism 12 passes through the transparent conveyor belt 3 and reaches the sensor mechanism 1 in those places where no mark 5 has been imprinted. In such cases, the sensor mechanism 1 is in the first operational mode, during which no mark 5 has as yet been detected. In this example, the sensor mechanism 1 incorporates a light receiver that receives the light from the lighting mechanism 12 through the transparent conveyor belt 3. In those places where a mark 5 has been imprinted on the conveyor belt 3 some of the light from the lighting mechanism 12 reaches the sensor mechanism 1, while additional components of the light are reflected from or absorbed by the mark 5, depending upon the optical density and color of the mark 5.

When the mark 5 on the transparent conveyor belt 3 is detected, the second operational mode is initiated by the triggering mechanism 14. The component of the light that passes through the mark 5 and that is always filtered by the mark 5 contains information about the optical density and the color of the marks 5. Different components of light pass through each individual mark 5, depending upon the density and color of the mark 5. These components of the light from the lighting mechanism 12 that have passed through the marks 5 are spectrally analyzed in the sensor mechanism 1.

In the second operational mode, the process set forth above is quickly repeated sequentially using several colors of light, and analysis of the transmitted beams from the different colors of the marks 5 is repeated accordingly. The color of each mark 5 is individually determined from the results coming from the different light colors. Initially, the leading edge of the printing medium is detected as described above or a signal is triggered that simulates the leading edge of the printing medium, and then the marks 5 are detected. The distance of the leading edge of the printing medium or the simulated leading edge of the printing medium from the marks 5 is always determined by counting the clock pulses. From this, it is determined whether the register of the mark 5 is properly positioned relative to the direction of travel, in track. After the marks 5 have been detected, the triggering mechanism 14, which is connected to the sensor mechanism 1, initiates a signal that starts a process for detecting the optical density and the color of each mark 5. In the present example, the colors and the optical densities of four marks 5 are determined in this manner, in that the lighting mechanism 12 sequentially executes a process of beaming different spectral light colors individually for each mark 5.

By the use of a differential diode 2, at least two photo diodes arrayed as differential diodes, a high level of sensitivity is achieved for the measurements. During the measurement, the mark 5 that is to be measured sequentially covers the light beam that is received by the two diodes of the differential diode 2 and creates a differential signal at the edges of the mark 5, which is used to measure the position of the edge of the mark 5. During this process, the sensor mechanism 1 is being operated in the transmission mode, i.e., the beams of light, which are generally multi-colored, from the sensor mechanism 1 in the second operational mode pass through the transparent conveyor belt 3 and are reflected from the mark 5 or the printing medium. Another possibility consists of determining the sum signal of the differential diode 2. The sum signal is measured in the moment when the mark 5 covers the light beam received by the two diodes of the differential diode 2. The sum signal of the two diodes of the differential diode 2 is proportional to the optical density of the mark 5 and therefore the optical density of the mark 5 can be determined from the sum signal.

The above-described detection of the proper positioning of the register, the optical density, and the color of the mark 5 is preferably done during the printing process. The results of the measurements are then used by the machine control system in the control mechanism 10 of the printing machine to execute the necessary corrections, which restore the desired register positioning, optical density, and color in the printing machine. For this purpose, the marks 5 are imprinted between the printing media on the conveyor belt. In another version of the invention the marks 5 are imprinted on the printing medium, whereby the light beam passes through the printing medium. In this version, the sensor mechanism additionally detects the leading edge of the printing medium, possibly a sheet of paper, in order to determine whether the register is properly positioned, instead of simulating the leading edge of the printing medium as described above and as would be the case during a calibration run without a printing medium. A count of the clock pulses between the leading edge of the printing medium that has been detected by the sensor mechanism 1 and the edge of the mark 5 then serves to determine the proper positioning of the register as described above.

In digital printing machines, in particular, various printing media with different colors are used, whereby detection of the optical characteristics from the marks 5 imprinted thereon is made difficult. In addition, the conveyor belt used to carry the marks 5 becomes soiled and changes its optical characteristics over the course of time. These changes especially influence the measurement results when measurements are taken in the light passage mode, in which the light from the sensor mechanism 1 or the lighting mechanism 12 passes through the transparent conveyor belt 3 or the mark 5, and the light transmitter and receiver are mounted on opposite sides of the conveyor belt 3. Consequently, before beginning a printing process, a calibration run is made in which known densities and colors of the marks 5 of various, differently colored printing media are measured, and the resulting values are stored. In addition, measurements are taken with variously shaded conveyor belts 3, whereby the densities and colors of the marks 5 are known, and the obtained values are stored, whereby the various shadings simulate the empirically determined levels of soiling of the conveyor belt 3.

Before beginning a printing process, the shading of the conveyor belt 3 is determined by a calibration run, as described above, or is stored in the control mechanism 10 as an estimated value that is dependent upon the age of the conveyor belt 3. Thus, various values that correspond to the age of the conveyor belt 3 are stored in the control mechanism 10. The values measured during calibration with respect to different printing media and different shadings of the conveyor belt 3 are stored in the control mechanism 10 as correction values that are retrieved and used during the printing process. The values for the optical density and the color of the mark 5 that are measured by the sensor mechanism 1 in the second operational mode are multiplied by these printing-medium-specific and/or conveyor-belt-specific correction values. The result of the multiplication of the measured values by the correction value that is dependent upon the printing medium and by the correction value that is dependent upon the conveyor belt 3 ultimately yields the optical density and the color of the mark 5 independent of the influences mentioned above. In this way, the effects of different types of printing media relative to their own coloring, and the age or soil-induced shadings of the conveyor belts 3 are compensated for during measurement of the optical density and the color of marks 5.

The invention has been described in detail with particular reference to certain preferred embodiments thereof, but it will be understood that variations and modifications can be effected within the spirit and scope of the invention.

What is claimed is:

1. A process for controlling a sensor mechanism (1) for a printing machine, comprising the steps of: setting a first operational mode for said sensor mechanism (1) wherein said sensor mechanism (1) detects at least one mark (5), and responsive to detection of said mark (5), initiating a second operational mode for said sensor mechanism (1) in which said sensor mechanism (1) measures values of the optical density and the color of said mark (5).

2. A process according to claim 1, wherein said optical density of said mark (5) is determined and subsequently said color of said mark (5) is determined by using said information pertaining to said optical density.

3. A process according to claim 2, wherein said detection of said edge of said mark (5) in said first operational mode initiates beaming of a light containing at least three colors onto said mark (5) in said second operational mode.

4. A process according to claim 1, wherein during said first operational mode a determination is made as to whether said mark (5) is in register.

5. A process according to claim 1, wherein said values of said optical density and said color of said mark (5) in said case of different printing media that bear said mark (5) are multiplied by a correction value that is specific to said printing medium.

6. A process according to claim 1, wherein said values of said optical density and said color of said mark (5) relative to different shadings of a conveyor belt (3) as said bearer of said mark 5 are multiplied by a correction value that is specific to said conveyor belt.

7. A sensor mechanism (1) for a printing machine, comprising: a first operational mode for detecting a mark (5); a second operational mode for detecting said optical density of said mark (5) and said color of said mark (5); and a triggering mechanism (14) for initiating said second operational mode when said mark (5) is detected in said first operational mode.

8. A sensor mechanism according to claim 7, including a lighting mechanism (12) for beaming a multicolored light on said mark (5) in said second operational mode of said sensor mechanism (1).

9. A sensor mechanism (1), according to claim 7, including a differential diode (2) in said sensor mechanism (1) for receiving a light beam.

* * * * *